US009272823B2

(12) United States Patent
Bratsch

(10) Patent No.: US 9,272,823 B2
(45) Date of Patent: Mar. 1, 2016

(54) LID OF A CONTAINER

(75) Inventor: Christian Bratsch, Salzburg (AT)

(73) Assignee: Xolution GmbH, München (DE)

( * ) Notice: Subject to any disclaimer, the term of this patent is extended or adjusted under 35 U.S.C. 154(b) by 671 days.

(21) Appl. No.: 12/735,804

(22) PCT Filed: Feb. 23, 2009

(86) PCT No.: PCT/EP2009/052124

§ 371 (c)(1),
(2), (4) Date: Sep. 23, 2010

(87) PCT Pub. No.: WO2009/103817

PCT Pub. Date: Aug. 27, 2009

(65) Prior Publication Data

US 2011/0006062 A1 Jan. 13, 2011

(30) Foreign Application Priority Data

Feb. 21, 2008 (AT) ..... A 282/2008

(51) Int. Cl.
*B65D 51/18* (2006.01)
*B65D 47/28* (2006.01)
(Continued)

(52) U.S. Cl.
CPC ..... *B65D 47/286* (2013.01); *B65D 47/0866* (2013.01); *B65D 47/24* (2013.01); *B65D 2251/1008* (2013.01); *B65D 2251/1058* (2013.01); *B65D 2251/1066* (2013.01)

(58) Field of Classification Search
USPC ..... 220/254.4, 254.9, 281, 715, 714, 719, 220/849, 825, 508, 258.1, 254.3
See application file for complete search history.

(56) References Cited

U.S. PATENT DOCUMENTS 2,031,845 A * 2/1936 Morgan ..... 220/231
3,738,526 A * 6/1973 Zundel et al. ..... 220/269
(Continued)

FOREIGN PATENT DOCUMENTS

DE 19613246 10/1997
DE 19613256 10/1997
(Continued)

OTHER PUBLICATIONS

English Abstract of DE19613246.
(Continued)

*Primary Examiner* — Fenn Mathew
*Assistant Examiner* — Chetan Chandra
(74) *Attorney, Agent, or Firm* — Dykema Gossett PLLC

(57) ABSTRACT

The invention relates to a lid (8) of a container, especially a beverage can, comprising a substantially flat lid surface (9) and a preferably folded edge area, with at least one re-closeable pouring opening (10) being provided on the lid surface (9), a closure means (1) associated with the pouring opening (10) being provided on the bottom side of the lid surface (9) and an actuation means (6) which penetrates the lid surface (9) being arranged on the upper side of the lid surface (9) accessible from the outside, and the closure means (1) being movable from a closed position to an opened position through actuation of the actuation means (6), the closure means (1) being of integral configuration and being fixed entirely in a torsion-proof manner to the bottom side of the lid surface (9), and the actuation means (6) comprises a support element (12, 12', 14, 15) which cooperates with the lid surface (9) when the closure means (1) is in the opened position, the integral closure means (1) comprises a fastening part (3) for non-detachable connection with the lid surface (9), and a closure area (4) for closing the pouring opening (10) in a liquid-tight manner, with a joint (2) being provided between fastening part (3) and closure area (4), about which the closure area (4) of the closure means (1) can be swiveled against a restoring force, characterized in that the joint (2) is arranged as an area with increased flexibility disposed between the fastening part (3) and the closure area (4).

15 Claims, 9 Drawing Sheets

(51) Int. Cl.
*B65D 47/08* (2006.01)
*B65D 47/24* (2006.01)

(56) References Cited

U.S. PATENT DOCUMENTS

| | | | | | |
|---|---|---|---|---|---|
| 3,889,842 | A | | 6/1975 | Bennett | |
| 3,952,914 | A | * | 4/1976 | Vogt | 220/825 |
| 3,964,631 | A | * | 6/1976 | Albert | 220/715 |
| 4,133,446 | A | * | 1/1979 | Albert | 220/715 |
| 4,171,060 | A | * | 10/1979 | Howard et al. | 220/254.4 |
| 4,198,040 | A | * | 4/1980 | Colasent | 220/254.4 |
| 4,345,695 | A | | 8/1982 | Galloway et al. | |
| 4,746,032 | A | | 5/1988 | Huang | |
| 5,096,082 | A | | 3/1992 | Hoefler | |
| 5,141,150 | A | * | 8/1992 | Plaessmann | 229/123.3 |
| 5,143,248 | A | * | 9/1992 | Sawatsky | 220/711 |
| 5,775,534 | A | | 7/1998 | Webb et al. | |
| 6,427,861 | B1 | * | 8/2002 | Cho | 220/269 |
| 6,626,314 | B1 | * | 9/2003 | McHenry et al. | 220/254.2 |
| 7,686,182 | B1 | * | 3/2010 | Shukri | 220/711 |
| 7,823,740 | B2 | * | 11/2010 | Perra | 220/254.4 |
| 7,891,517 | B2 | * | 2/2011 | Simmons | 220/243 |
| 7,934,616 | B2 | * | 5/2011 | Felber | 220/259.2 |
| 8,118,184 | B2 | * | 2/2012 | Ruse, Jr. | 220/254.4 |
| 8,336,726 | B2 | * | 12/2012 | Ramsey et al. | 220/254.3 |
| 2005/0051552 | A1 | | 3/2005 | Kim | |
| 2010/0102060 | A1 | * | 4/2010 | Ruse, Jr. | 220/254.9 |
| 2010/0200590 | A1 | * | 8/2010 | Shadrach et al. | 220/254.9 |
| 2012/0312816 | A1 | * | 12/2012 | Barreto et al. | 220/254.7 |
| 2013/0233869 | A1 | * | 9/2013 | Tamarit Rios | 220/715 |

FOREIGN PATENT DOCUMENTS

| | | | | |
|---|---|---|---|---|
| DE | 19706112 | | 4/1998 | |
| DE | 19746539 | | 3/1999 | |
| DE | 20319105 | | 3/2004 | |
| EP | 0433502 | | 6/1991 | |
| EP | 1190952 | | 3/2002 | |
| EP | 1247752 | | 10/2002 | |
| EP | 1247752 | A1 * | 10/2002 | B65D 43/18 |
| GB | 2331284 | | 5/1999 | |
| WO | 9101253 | | 2/1991 | |

OTHER PUBLICATIONS

English Abstract of DE19613256.
English Abstract of DE19706112.
English Abstract of DE19746539.
English Abstract of DE20319105.

* cited by examiner

LID OF A CONTAINER

BACKGROUND OF THE INVENTION

1. Field of the Invention

The invention relates to a lid of a container, especially a beverage can, comprising a substantially flat lid surface and a preferably folded edge area, with at least one recloseable pouring opening being provided on the lid surface, a closure means associated with the pouring opening being provided on the bottom side of the lid surface and an actuation means which penetrates the lid surface being arranged on the upper side of the lid surface accessible from the outside, and the closure means being movable from a closed position to an opened position through actuation of the actuation means, the closure means being of integral configuration and being fixed entirely in a torsion-proof manner to the bottom side of the lid surface, and the actuation means comprises a support element which cooperates with the lid surface when the closure means is in the opened position, the integral closure means comprises a fastening part for non-detachable connection with the lid surface, and a closure area for closing the pouring opening in a liquid-tight manner, with a joint being provided between fastening part and closure area, about which the closure area of the closure means can be swivelled against a restoring force.

2. The Prior Art

Numerous beverage cans have become known which have a re-closable pouring opening. DE 196 13 246 A1 discloses a closure means with substantially the same diameter which is applied to the already existing lid, which closure means closes a pouring opening disposed in the lid by twisting. Similar apparatuses where some of these closure means cover the lid only partly have been described in DE 196 13 256 B4, DE 197 06 112 C2, EP 1 247 752 B1 or U.S. Pat. No. 6,626,314 B1. The disadvantageous aspect in these closure means is their mostly complex arrangement which additionally requires constructional changes to the lid region of the can.

A further group of closure means for beverage cans consists of a pull tab which is fastened by means of a rivet connection to the can lid, with the handle part of the pull tab being arranged simultaneously as the closure means for the pouring opening, which after the opening of the pouring opening seals the pouring opening again by twisting and/or folding down the pull tab. Such elements are shown, among other things, in DE 197 46 539 A1, DE 203 19 105 U1, EP 1 190 952 A2, EP 1 097 086 B1 and EP 0 433 502 A1. These beverage cans all have a closure means which is applied from the outside to the pouring opening and partly protrudes beyond the lid edge, so that the same can be removed inadvertently and the content of the can is exposed to the ambient environment.

GB 2 331 284 A finally describes a closure system, which includes a pull tab for exposing a pouring opening and a closure means which is arranged on the bottom side of the lid of the can in the interior of the can, with a spring element pressing the closure means against the pouring opening. In order to enable the emptying of the can, parts of the closure means must be displaced against the pull tab. This closure means comes with the disadvantage that it is highly complex and requires a change to the conventional lid of the can. A slightly simpler arranged closure device which also consists of several parts is disclosed in U.S. Pat. No. 3,889,842, which also requires a complex changed lid. Similar reusable closure means are described in U.S. Pat. Nos. 4,746,032 A and 345,695 A.

It is therefore the object of the invention to eliminate the disadvantages of the state of the art as described above and to provide a lid for a can which has a secure closure system for resealing the can which can be mounted in a simple and cost-effective way in conventional lids.

SUMMARY OF THE INVENTION

This object is achieved in accordance with the invention by a lid of the kind mentioned above in such a way that the joint is arranged as an area with increased flexibility disposed between the fastening part and the closure area. In accordance with the invention, the integral closure means comprises a fastening part which is in connection with the lid surface in a non-detachable manner, and a closure area which seals the pouring opening in a liquid-tight manner, with a joint being provided between the fastening part and the closure area, about which the closure area of the closure means can be swivelled against a restoring force.

This joint is arranged in an especially simple and cost-effective embodiment of the invention as a region with a low cross section of the material disposed between the fastening part and the closure area. When the closure means is made of an elastic material, especially a resiliently flexible one, the closure means is folded away upon actuation of the actuation means, with a respective force needing to be employed which corresponds to the elastic properties of the material of the closure means.

By attaching the integral closure means in a torsion-proof manner, e.g. by gluing or soldering, to the bottom side of the lid surface, rapid mounting of the closure means on a conventional lid is enabled, with hardly any changes being required to the lid, or only slight ones, e.g. by simple punching of the lead-through of the actuation means through the lid. Especially the edge region of the lid remains unchanged, so the placement and fixing of the lid on the container, especially the can, can occur in the conventional manner.

It is especially simple to produce and thus cost-effective when the closure means is arranged as a two-component injection-molded part.

The actuating means which is in connection with the closure means, which actuating means can also be arranged integrally with the closure means for example, ensures on actuation that the closure means is flipped away from the plane of the pouring opening into the interior of the can, which means it is movable in a substantially perpendicular way relative to the lid surface to the open position. The pouring opening is thus released and the content of the can is thus removable.

In order to avoid having to provide a continual action of force on the closure means during the emptying of the can, the holding element of the actuation means is advantageously arranged as a latching nose for accommodating at least one edge of the lid surface in the open position of the closure means. The closure means is thus fixed in the open position and the content of the can can be removed without having to exert any additional force on the actuation means. Alternatively, the closure means can be held in the open position by a latching joint.

The actuation means can be arranged in different ways. It is shaped in the form of a wedge in a preferred embodiment. The wedge surface can be in a straight line or curved in the manner of a screw.

In another development of the invention, the actuation means is arranged to be twistable on the top of the lid surface, substantially about a central axis extending substantially perpendicularly to the lid surface. It acts upon the closure means when twisted, so that the closure area is swiveled to the open position.

In a further variant of the invention, the actuation means is arranged as a lever with a latching nose, which lever protrudes upwardly in a perpendicular way from the lid surface.

Improved sealing of the pouring opening by the closure means is given when an additional sealing means can be arranged between the closure area of the closure means and the lid surface. It can be arranged for example on the side of the closure means facing the pouring opening. Similarly, it can be attached to the bottom side of the lid surface, with the same advantageously enclosing the edges of the pouring opening in order to prevent injuries while drinking from the can.

Preferably, the sealing means forms the region made of elastic material, so that the number of individual parts of the lid is thus reduced and a higher stability of the closure means of the pouring opening of a beverage can is thus achieved in accordance with the invention.

An important aspect especially in food product packaging is packaging safety. This shall mean within the scope of this disclosure the protection with which the content of the food package, which in this case is the content of the beverage can, is protected from manipulation or removal until it is opened by the consumer. Therefore, the pouring opening is preferably closed off with a seal before the first opening. This seal is in the simplest of cases a tab or a label which covers the pouring opening and needs to be removed before the content of the can can be removed.

In another embodiment of the invention, the seal is arranged as a pre-punched closure tab which is pulled off during the first opening of the container and exposes the pouring opening in the lid surface.

The pouring opening is sealed in a further variant before the first opening with the closure means, with the actuation means having a securing device. The actuation means can be provided for example with a label which covers the lid surface at least partly, so that the label will tear upon actuation of the actuation means and thus indicate a manipulation of the container.

The safety device is especially preferred which has a predetermined breaking point which is broken open upon the first opening of the container. When a label is used as a securing means for example, it may be removed entirely under certain circumstances and then reapplied to the container again without a recognizable difference to an untouched label when glancing only briefly at the container. A manipulation of the content of the container is thus not recognizable at first glance. In the case of a safety device with a predetermined breaking point however, it is not possible to hide the manipulation of the seal and it is therefore especially secure for the consumer.

In order to securely transport the can after the first opening of the same without releasing the remaining content of the can by inadvertent pressing of the closure means, the actuation means covers the pouring opening in the closed position in a further preferred embodiment of the invention. It is thus prevented that during the transport of the re-closed can in a bag, further objects disposed in the bag can move the closure means from its closed position to an at least partly opened position and the content of the can will pour into the bag.

In a further embodiment of the invention, a ventilation device is provided in addition to the pouring opening which can be sealed by the closure means together with the pouring opening. This ventilation device allows emptying the content of the can in an especially simple way without any interruption due to negative pressure in the beverage can.

It is especially cost-effective when the closure means and/or the actuation means are made of plastic. It is understood that the employed material must be compatible to foodstuffs when packaging for foodstuffs is used.

The invention will now be explained in greater detail by reference to non-limiting embodiments

DETAILED DESCRIPTION OF THE DEPICTED EMBODIMENTS

Figure 1:
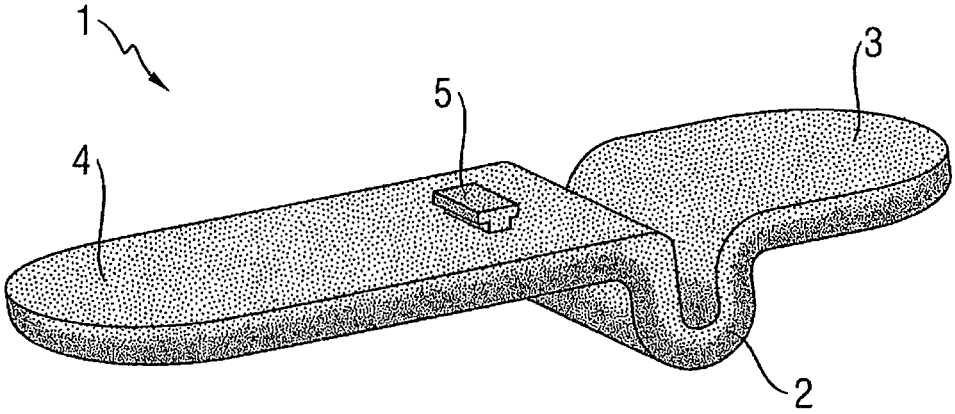
FIG. 1 shows a closure means in accordance with the invention.

As is shown in FIG. 1, the closure means according to the present invention is a substantially planar plate which is subdivided into two regions by an indentation 2. The region with the smaller area is the fastening part 3 of the closure means 1 which is used for torsion-proof fastening of the closure means 1 to the bottom side of the lid of a container. In the region with the larger extension, which is the closure area 4, there is attachment 5 which is T-shaped in its cross section and is integrally produced with the closure means 1. The closure means 1 is made in the illustrated embodiment of a resiliently flexible material, especially plastic.

Figure 2:
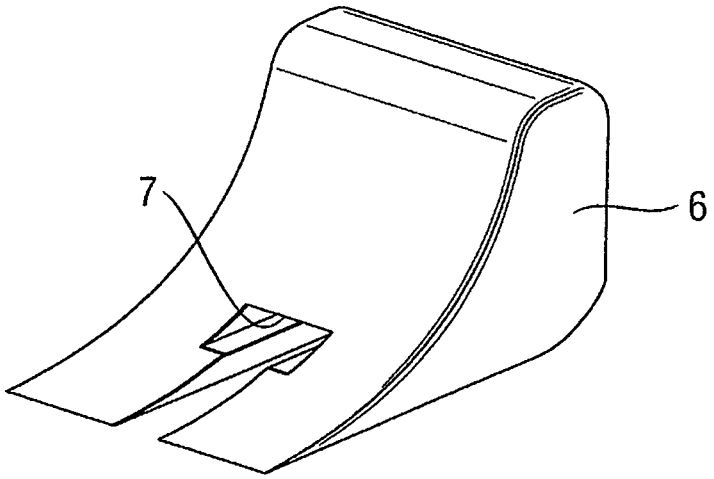
FIG. 2 shows a wedge-shaped actuation means.
Figure 3:
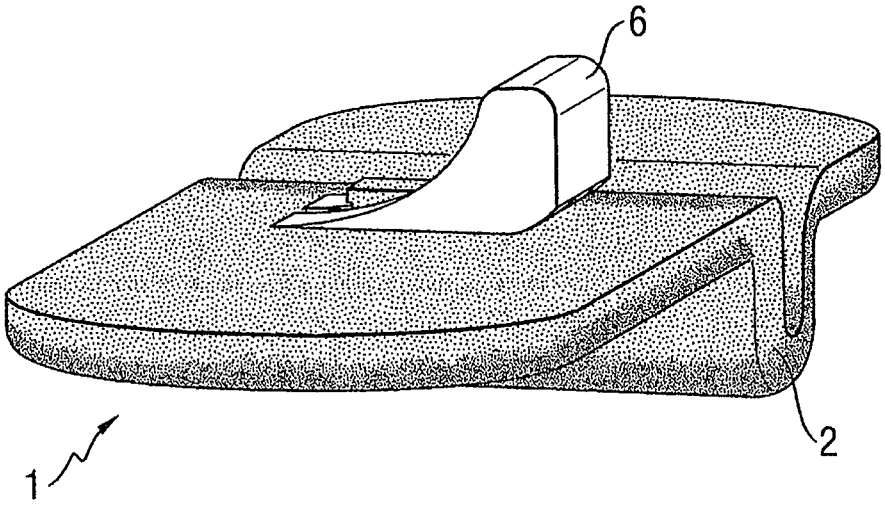
FIG. 3 shows the closure means of FIG. 1 with the wedge-shaped actuation means of FIG. 2.

An actuation means 6, which is arranged in a wedge-like manner according to FIG. 2, can be fastened to said attachment 5. For this purpose, the actuation means 6 includes a recess 7, the cross section of which corresponds substantially to that of the attachment 5. FIG. 3 shows the closure means 1 with inserted actuation means 6.

Figure 4:
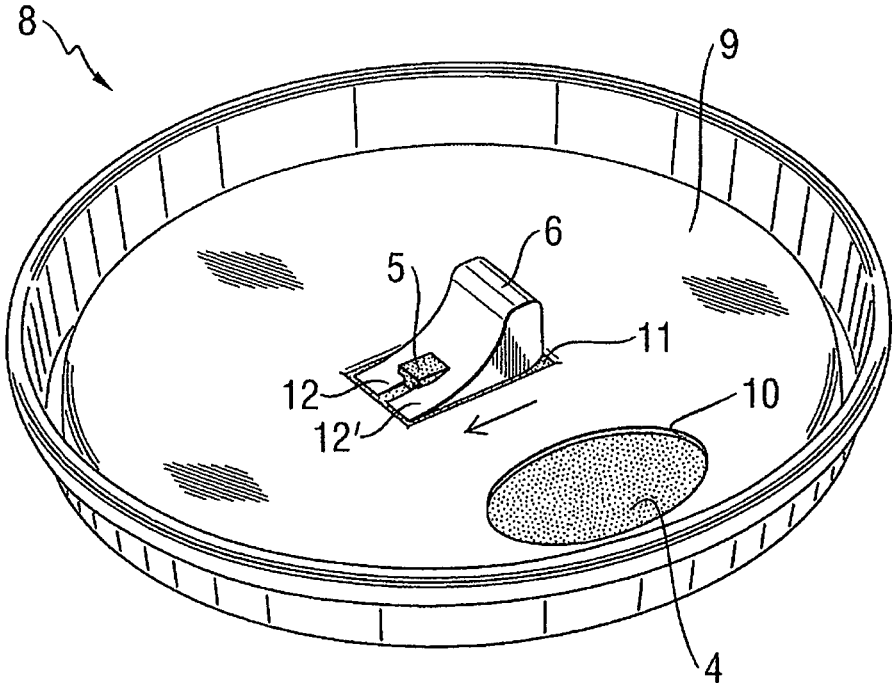
FIG. 4 shows a lid in accordance with the invention with the closure means of FIG. 3.

The closure means 1 is fastened in accordance with the invention to the bottom side (interior face) of a lid 8 of a container especially to the bottom side of the surface (substantially planar covering member) 9 of the lid of a beverage can. The closure area 4 seals a pouring opening 10 which is arranged in an eccentric manner on the surface 9 of the lid. The T-shaped attachment 5 protrudes through a recess 11 disposed in the central region of the surface 9 of the lid, on which the wedge-like actuation means is placed. In order to release the pouring opening 10 by swiveling the closure area 4 of the closure means 1 from the plane of the surface 9 of the lid, the actuation means 6 is moved in the direction of the arrow according to FIG. 4 in such a way that the two legs 12, 12' slide between the surface 9 of the lid and the closure means 1. The wedge-like actuation means 6 is moved simultaneously over the attachment 5 which engages in the recess 7 of the actuation means 6.

As a result of the increasing cross section of the two legs 12, 12', the distance between the surface 9 of the lid and the closure means 1 increases, with the closure area 4 being swiveled about a swiveling axis disposed substantially in the indentation 2. The indentation 2 which is disposed in the closure means 1 thus acts as a joint, with the closure area 4 being swiveled about its axis out of the plane of the surface 9 of the lid.

Figure 5:
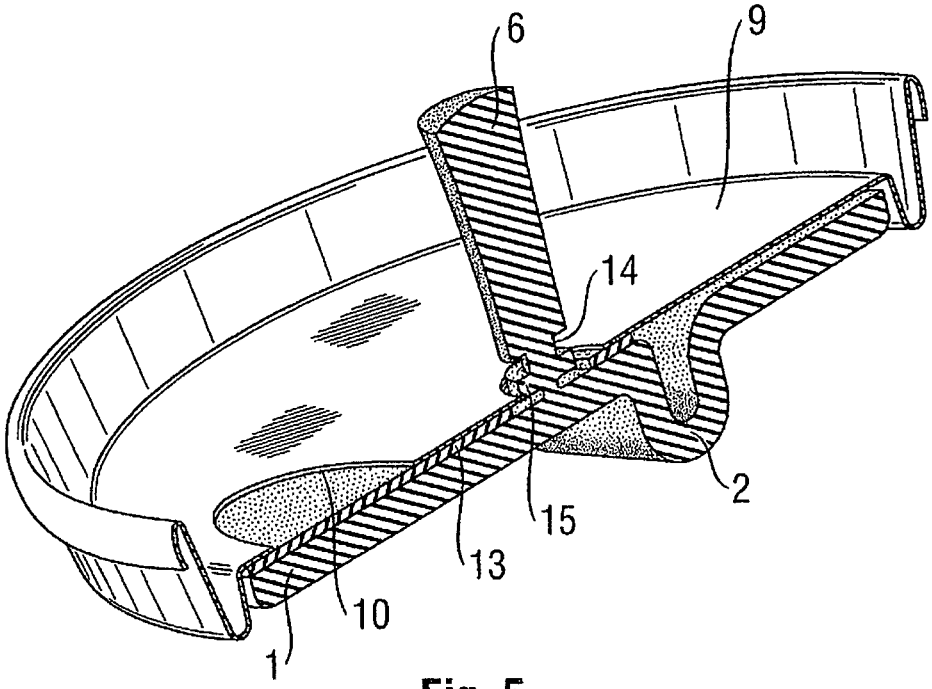
FIG. 5 shows a cross-sectional view of a lid with a further embodiment of the actuation means with sealed pouring opening.
Figure 6:
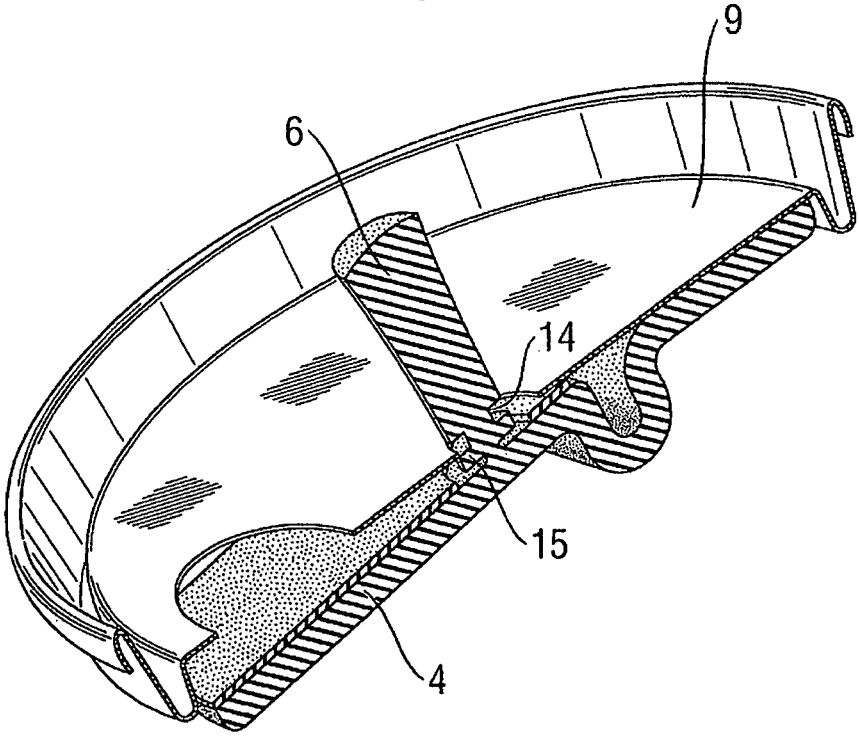
FIG. 6 shows the lid of FIG. 5 with the closure means in the opened position.

FIG. 5 and FIG. 6 show a further embodiment of the invention. The closure means 1 is again arranged on the bottom side of the surface 9 of the lid in order to seal the pouring opening 10 with its closure area 4. A sealing material 13 is arranged between the closure area 4 and the surface 9 of the lid, which sealing material seals additionally and prevents leakage of the content of the container. The closure means 1 is pressed against the pouring opening in the closed position as shown in FIG. 5 by a pretension resulting from the shape of the closure means made of elastic material on the one hand, and the pressing pressure increases further on the other hand when carbonated beverages are filled into the container for example.

In this embodiment, the actuation means 6 is a substantially cylindrical lever which is connected with the closure means 1 through a bore in the surface 9 of the lid. In this case, the lever is either made integrally with the closure means 1 or is fastened to the same via a screwed connection for example. The actuation means 6 comprises a constriction 14 at its bottom end facing the surface of the lid, adjacent to which there is a region 15 with the original diameter of the lever 6. When the lever 6 is pressed down, the closure means 1 moves towards the interior of the container, as shown in FIG. 6, and releases the pouring opening 10. The region 15, which acts as a latching nose, slides here beneath the surface 9 of the lid, whereas the edge of the surface 9 of the lid engages in the constriction 14. In this way, the closure area 4 is fixed in its position when folded away and the container can be emptied. In order to reseal the pouring opening 10, it is merely necessary to push the actuation means 6 in the direction opposite of the pouring opening, so that the edge of the surface 9 of the lid will slide out of the constriction 14 again and will release the latching nose again.

Figure 7:
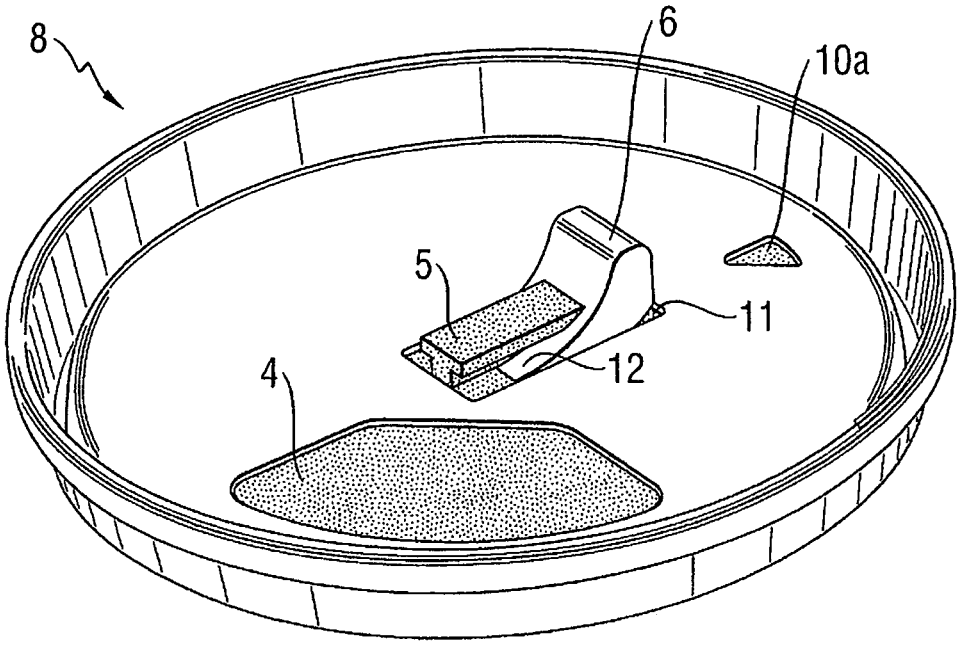
FIG. 7 shows an alternative embodiment of a lid in accordance with the invention in an oblique view from above.
Figure 8:
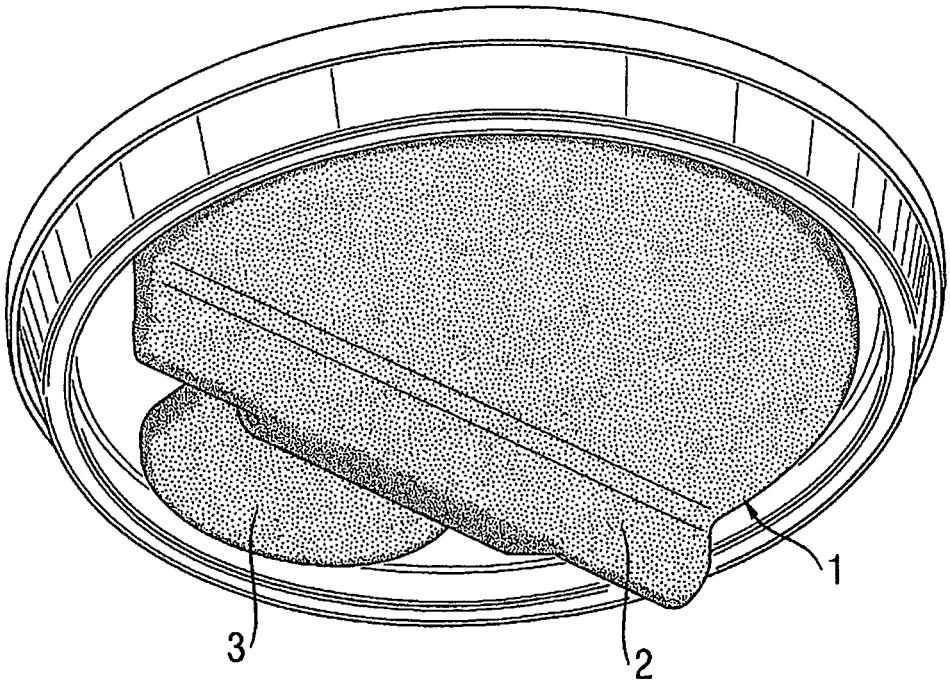
FIG. 8 shows the lid of FIG. 7 in an oblique view from below.

The lid of FIG. 7 and FIG. 8 differs from the lids as described above in such a way that an enlarged pouring opening 10 is arranged in a laterally offset manner and a ventilation opening 10*a* is additionally provided. Both openings 10 and 10*a* can be closed by a respectively arranged closure means 1.

The drawings show clearly that the closure means 1 is arranged merely in the region of the surface 9 of the lid and the edge region of the lid 8 remains free. For the purpose of mounting the closure means 1, it merely needs to be fastened with its fastening part 3 to the bottom side of the lid 8 in such a way that the closure area 4 completely covers the pouring opening 10. The actuation means 6 is then fastened to the closure means 1 through a recess 11 or bore disposed in the surface 9 of the lid. The lid 8 can then be fastened to the container in the known manner without having to take special precautions or make changes to the machines used for this purpose.

Figure 9:
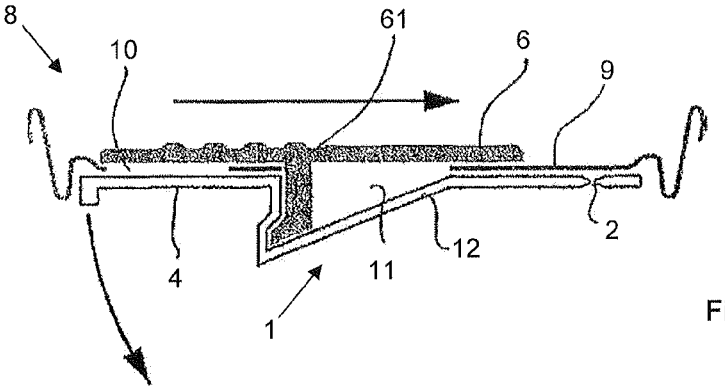
FIG. 9 shows a further embodiment of a lid in accordance with the invention in a sectional view.
Figure 10A:
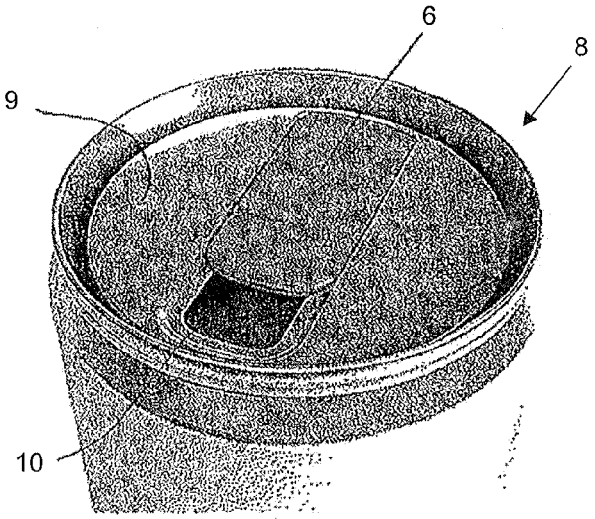
FIG. 10*a* and FIG. 10*b* show an oblique view of the lid of FIG. 9.
Figure 10B:
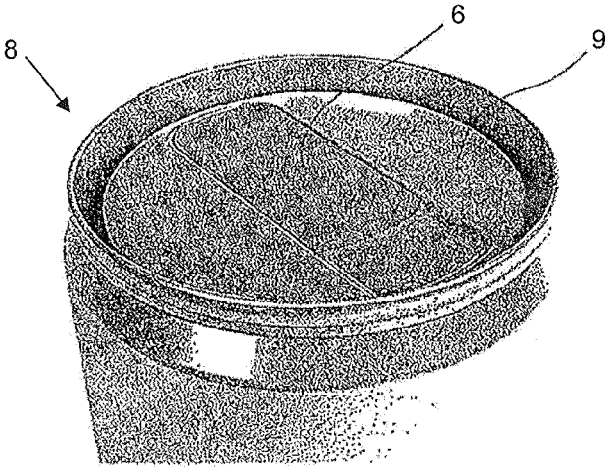
Figure 11A:
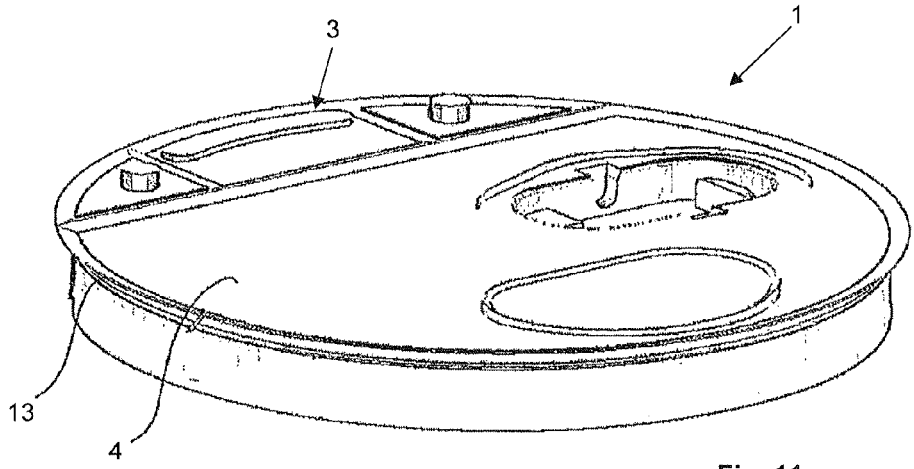
FIG. 11*a* shows an alternative embodiment of the closure means in accordance with the invention in an oblique view with a sealing element.
Figure 11B:
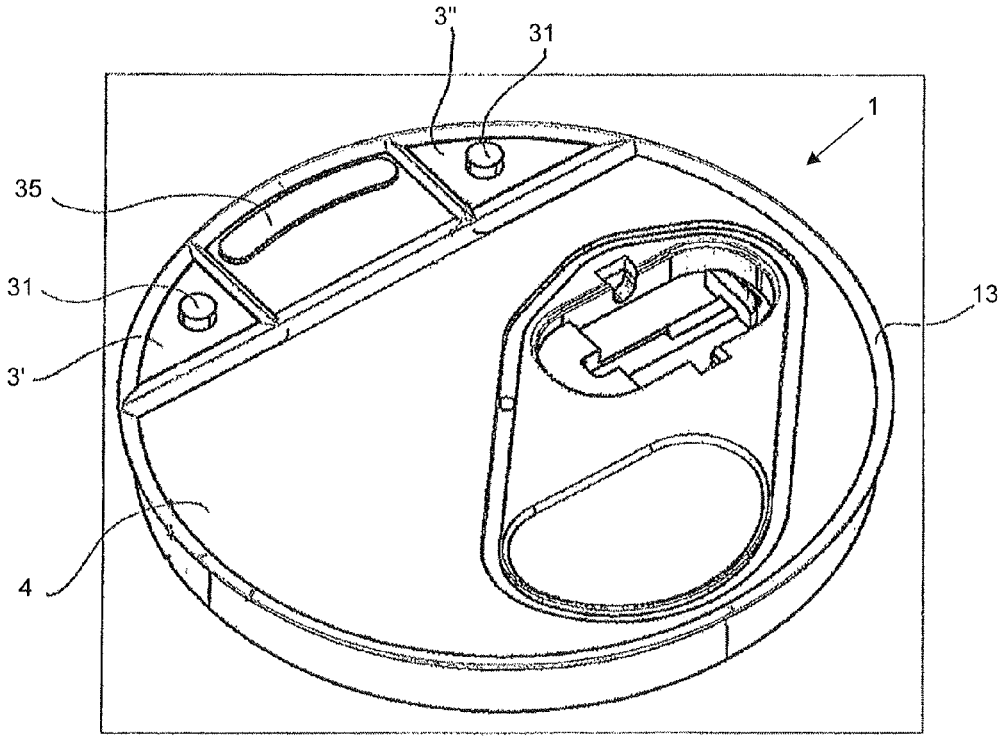
FIG. 11*b* shows a view from above of the closure means of FIG. 11*a;*

A further variant of the invention is shown in the FIGS. 9 to 10*b*. An actuation means 6 with a hook-like projection 61 which penetrates the surface 9 of the lid is arranged on the lid 8 of a beverage can. Projection 61 latches in the closed position (FIG. 9 and FIG. 10*b*) into a fitting recess 11 of the closure means 1 arranged beneath the surface of the can. In order to open the drinking orifice 10 by displacing the actuation means 6 in the direction of the arrow in a plane parallel to the surface 9 of the can, the projection 61 is moved along an inclined portion 12 of the recess 11, so that the closure area 4 of the closure means 1 moves along the curved arrow into the interior of the can, with the swiveling occurring via a joint 2 which is arranged as a region with a lower cross section of the material.

The variant shown in FIG. 11*a* to FIG. 13*b* concerns a closure means 1 which is arranged as a two-component injection-molded part. The injection-molded part consists of a closure area 4 made of a substantially rigid material and tripartite fastening part 3, with the two outer fastening areas 3', 3" having an elongated fasterner 31, through which the closure means 1 can be connected with the surface 9 of the can. The middle part disposed between the two fastening areas 3', 3" forms a spring element 32 which returns to the closure area 4 to the closed position. A projection 35 is provided on the spring element 32 which causes the spacing of the spring element 32 relative to the surface 9 of the lid, so that the pretension required for the closing of the pouring opening 10 is built up on closure area 4 of the closure means 1 which is preferably integrally arranged with the spring element 32.

Figure 12:
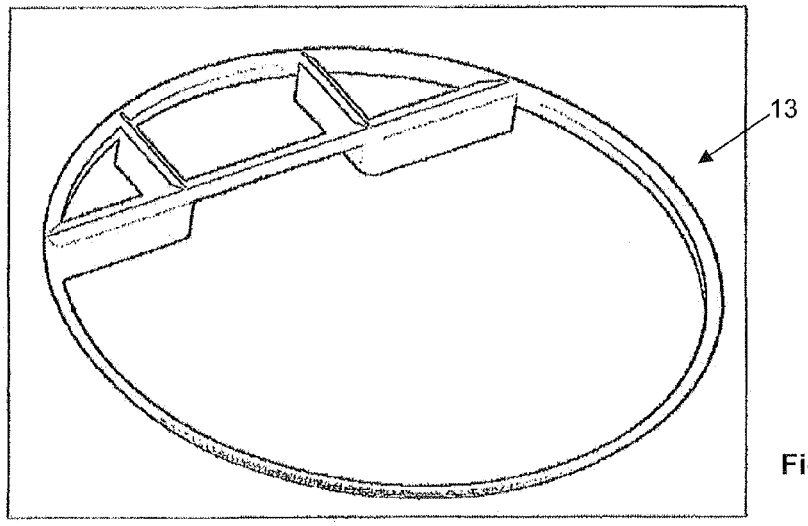
FIG. 12 shows an oblique view of the sealing element.
Figure 13A:
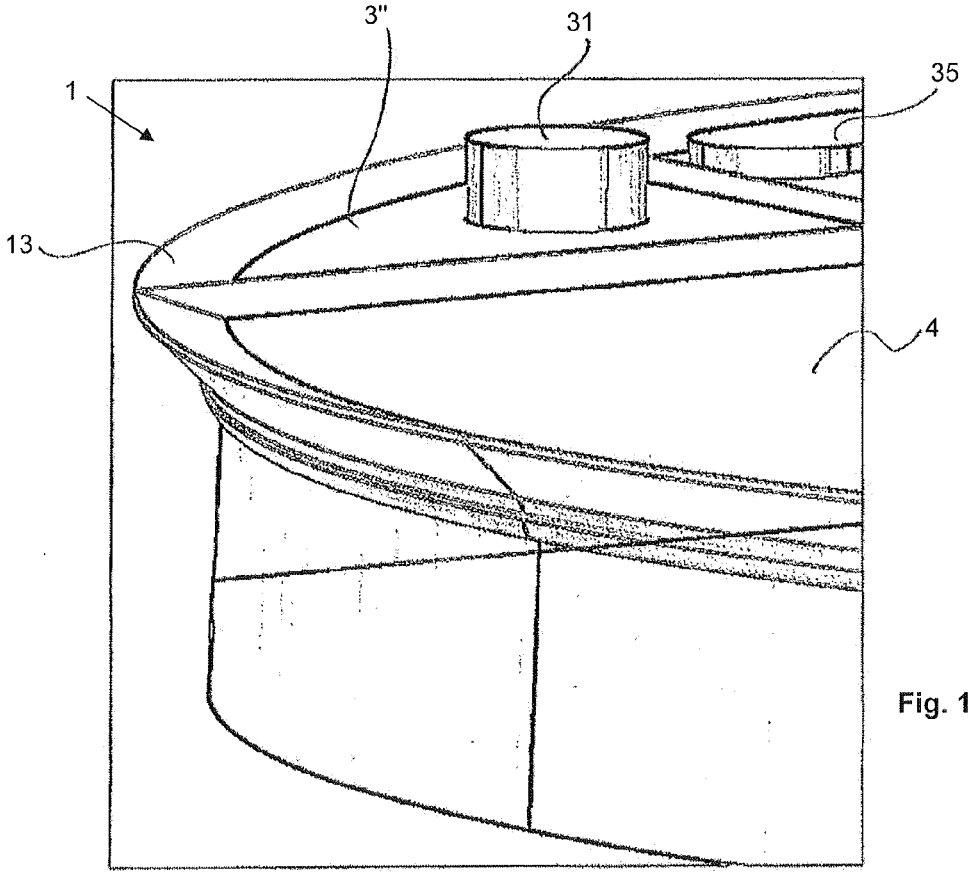
FIG. 13*a* shows an oblique view of an edge region of the closure means of FIG. 11*a;*
Figure 13B:
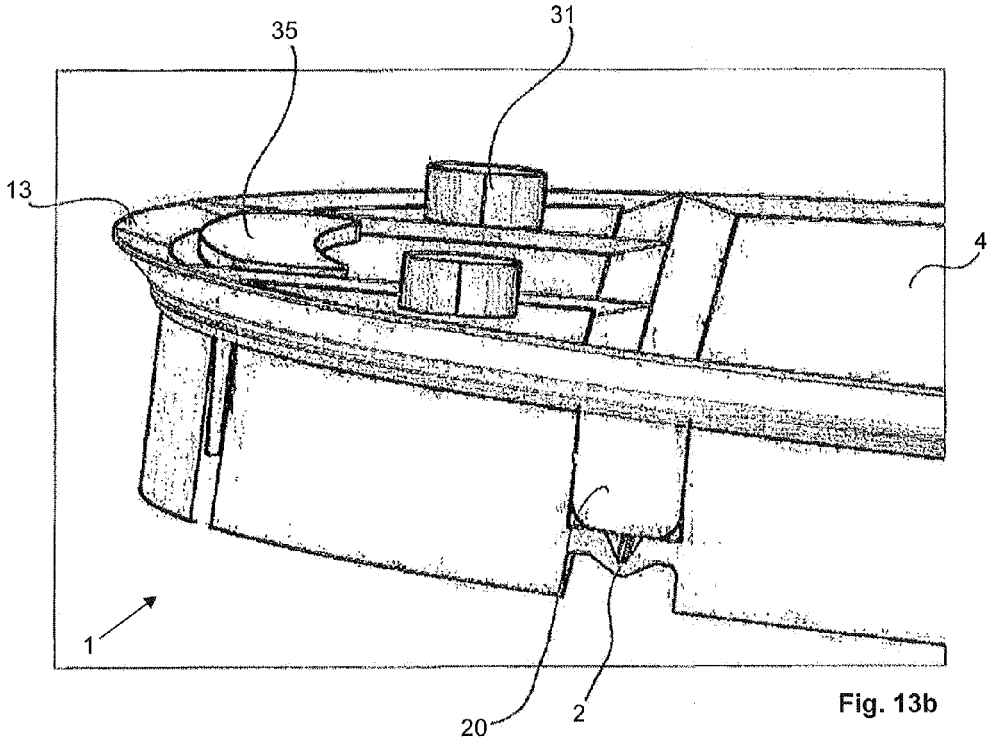
FIG. 13*b* shows an oblique view of a further edge region of the closure means of FIG. 11*a;*

The closure means 1 further comprises a sealing element 13 whose arrangement is shown especially in FIG. 12. On the one hand, sealing element 13, which is made of a flexible material seals the closure means 1 against the edge of the lid 8 with it being arranged along the outside edge of the closure means 1. On the other hand, it is arranged between fastening part 3 and closure area 4 and thus acts as a joint 20. In the embodiment shown in FIG. 13*b*, the closure means 1 additionally comprises an area 2 with reduced cross section of the material which also supports the swiveling of the closure area 4 into the interior of the can. In another variant of the invention, this area acts as a sole joint, so that fastening part 3 and closure area 4 are arranged as two separate parts (not shown).

Figure 14A:
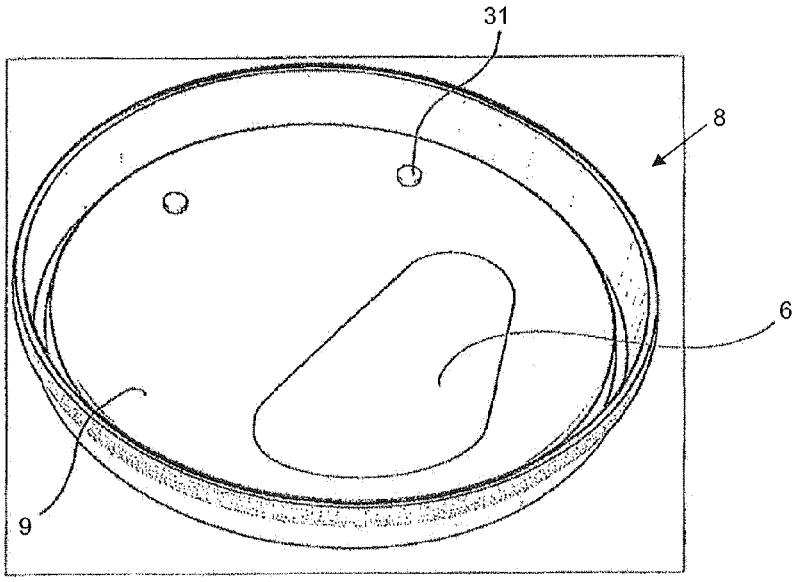
FIG. 14*a* and FIG. 14*b* show an oblique view of a lid in accordance with the invention with the closure means of FIG. 11*a*.
Figure 14B:
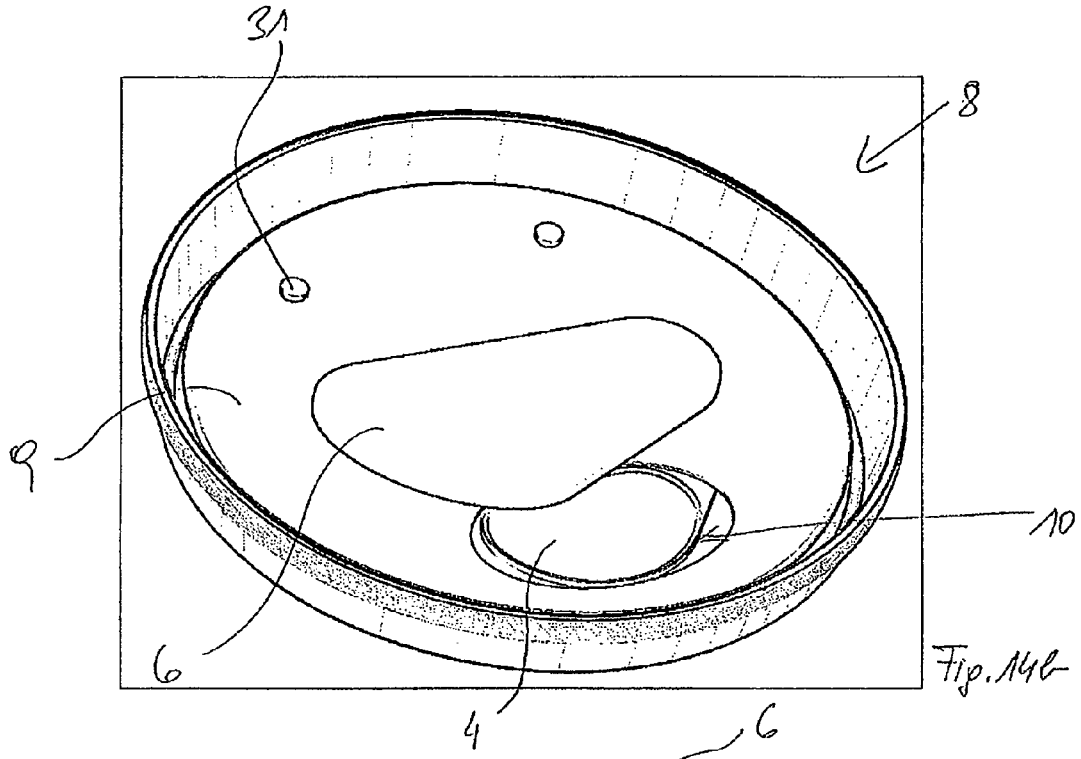
Figure 15:
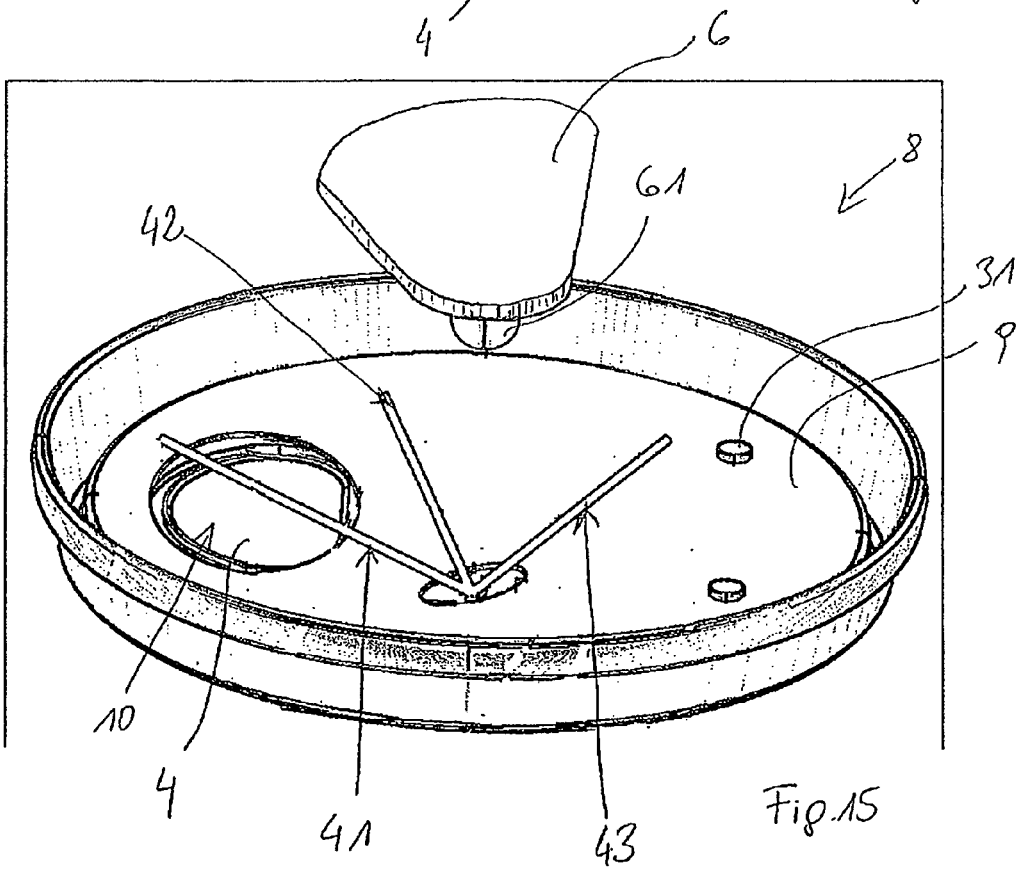
FIG. 15 shows a partly exploded oblique view of the lid of FIG. 14*a*.

FIG. 14*a* to FIG. 15 show the closure means 1 of FIGS. 11*a* to 13*b* with the associated actuation means 6, with the closure means 1 being arranged beneath the surface 9 of the can. The actuation means 6 is shown in FIG. 14*a* in the closed position, with the same simultaneously sealing the pouring opening 10. In FIG. 14*b*, the actuation means 6 is swiveled parallel to the plane of the surface 9 of the can in such a way that it releases pouring opening (drinking opening) 10, but the closure area 4 of the closure means 1 is not yet flipped into the interior of the can. Following a further twisting of the actuation means 6 in a clockwise manner towards the fasteners 31 for example, a pin 61 protruding through the surface 9 of the can (FIG. 15) produces a swiveling of the closure area 4 into the interior of the can for releasing the drinking orifice 10. FIG. 15 again shows three positions of the actuation means 6 which is twistable in this embodiment of the invention along the surface of the can. In position 41 the actuation means 6 covers the pouring opening 10 entirely, so that the closure area 4 of the closure means cannot be pressed inadvertently into the interior of the can. The pouring opening 10 is exposed in position 42, but still sealed by the closure area 4 of the closure means 1. In position 43 the pouring opening 10 has been exposed entirely and the content of the can can be removed.

It is understood that the embodiments as described above shall be understood in a non-limiting manner for the invention. Especially the shape of the closure means can be adjusted to the respective opening to be closed. The shape of the actuation means is also not limited to the described shapes, but can assume any shape that is suitable for the fixing of the closure means in a position where it is folded away. Furthermore, additional restoring elements can be provided which force the closure means to a closed position.

The invention claimed is:

1. A lid for a container, said lid comprising:

a substantially planar covering member and a folded peripheral portion, said covering member defining an exterior face and an interior face and having a pouring hole there through for pouring of a liquid, a one-piece closure means for controlling flow through said pouring hole, said closure means comprising a fastening portion and a covering portion separated from the fastening portion by a joint, said fastening portion including first, second and third segments, said first and third segments being located on respective opposite sides of said second segment and each of said first and third segments including individual elevated fastener means protruding through said cover member and respectively attaching said first and third segments to said interior face of said covering member, and said covering portion being positioned over said pouring hole and spring biased by said second segment against said interior face of said covering member to close said pouring hole, and said second segment including a projection causing a spacing of said second segment relative to said interior face of said covering member to provide said spring bias;

an actuation means for separating said covering portion of said closure means from said interior face of said covering member to open said pouring hole against a bias of said second segment.

2. The lid according to claim 1, including a projection that extends between the second segment of said fastening portion of said closure means and said interior face of said covering member.

3. The lid according to claim 1, wherein at least one of the closure means and the actuation means consists of plastic.

4. The lid according to claim 1, including an additional sealing means between the closure area of the closure means and the lid surface.

5. The lid according to claim 4, wherein the additional sealing means forms an area comprised of elastic material.

6. The lid according to claim 1, including a seal for closing off the pouring opening.

7. The lid according to claim 6, wherein the seal is a pre-punched pull tab.

8. The lid according to claim 1, wherein the pouring hole is closed with the closure means, with the actuation means having a securing device.

9. The lid according to claim 8, wherein the securing device has a predetermined breaking point.

10. The lid according to claim 1, wherein the actuation means covers the pouring opening in the dosed position.

11. The lid according to claim 1, wherein the joint is an area with a lower cross section of the material.

12. The lid according to claim 1, wherein the joint is an area which is made of an elastic material.

13. The lid according to claim 12, wherein the closure means s a two-component injection-molded part.

14. The lid according to claim 1, wherein the closure means consists of a flexibly resilient material.

15. The lid according to claim 1, wherein the closure means can be moved from the closed position to the opened position substantially perpendicularly to the lid surface.

* * * * *